US011131322B2

(12) United States Patent
Grothe et al.

(10) Patent No.: US 11,131,322 B2
(45) Date of Patent: Sep. 28, 2021

(54) STRUCTURAL ASSEMBLY FOR A COMPRESSOR OF A FLUID FLOW MACHINE

(71) Applicant: ROLLS-ROYCE DEUTSCHLAND LTD & CO KG, Blankenfelde-Mahlow (DE)

(72) Inventors: Patrick Grothe, Berlin (DE); Thomas Giersch, Koenigs Wusterhausen (DE); Frank Heinichen, Berlin (DE); Bernd Becker, Berlin (DE); Maximilian Juengst, Frankfurt a. M. (DE)

(73) Assignees: ROLLS-ROYCE DEUTSCHLAND LTD & CO KG, Blankenfelde-Mahlow (DE); TECHNISCHE UNIVERSITÄT DARMSTADT, Darmstadt (DE)

( * ) Notice: Subject to any disclaimer, the term of this patent is extended or adjusted under 35 U.S.C. 154(b) by 182 days.

(21) Appl. No.: 16/453,193

(22) Filed: Jun. 26, 2019

(65) Prior Publication Data

US 2020/0011346 A1 Jan. 9, 2020

(30) Foreign Application Priority Data

Jul. 3, 2018 (DE) ..... 10 2018 116 062.3

(51) Int. Cl.
*F04D 29/52* (2006.01)
*F04D 29/68* (2006.01)
*F04D 27/02* (2006.01)

(52) U.S. Cl.
CPC ..... *F04D 29/526* (2013.01); *F04D 29/685* (2013.01); *F04D 27/0207* (2013.01)

(58) Field of Classification Search
CPC .... F04D 29/526; F04D 29/545; F04D 27/023; F04D 27/0238; F01D 11/08; F01D 11/10;
(Continued)

(56) References Cited

U.S. PATENT DOCUMENTS 3,890,060 A * 6/1975 Lipstein ..... F04D 29/664 415/119
6,736,594 B2 * 5/2004 Irie ..... F04D 29/547 415/128

(Continued)

FOREIGN PATENT DOCUMENTS

CN 201152282 Y 11/2008
CN 201190695 Y 2/2009

(Continued)

OTHER PUBLICATIONS

German Search Report dated Jul. 2, 2019 for counterpart German Application No. 10 2018 116 062.3.

(Continued)

*Primary Examiner* — Richard A Edgar
(74) *Attorney, Agent, or Firm* — Shuttleworth & Ingersoll PLC; Timothy Klima

(57) ABSTRACT

A structural subassembly for a compressor of a turbomachine, which has a rotor having a plurality of blades, which extend radially in a flow path of the turbomachine, and a compressor casing, which forms a flow path boundary, which delimits the flow path through the turbomachine radially on the outside. In this subassembly, the compressor casing has casing structuring adjoining the rotor. It is envisaged that the compressor casing has a plurality of circumferential segments, which extend in the circumferential direction, wherein only one or only some of the circumferential segments forms or form casing structuring.

17 Claims, 5 Drawing Sheets

(58) Field of Classification Search
CPC ..... F01D 11/12; F01D 11/122; F01D 11/125; F01D 11/127; F01D 25/24
USPC ..... 415/58.5, 58.7
See application file for complete search history.

(56) References Cited

U.S. PATENT DOCUMENTS

| | | | | |
|---|---|---|---|---|
| 6,905,305 | B2 * | 6/2005 | James | F04D 29/526 415/119 |
| 8,100,629 | B2 * | 1/2012 | Lebret | F04D 29/526 415/58.6 |
| 8,382,422 | B2 | 2/2013 | Guemmer | |
| 8,419,355 | B2 * | 4/2013 | Guemmer | F04D 29/526 415/173.1 |
| 8,915,699 | B2 | 12/2014 | Brignole et al. | |
| 9,291,099 | B2 | 3/2016 | Sakai et al. | |
| 9,587,509 | B2 * | 3/2017 | Guemmer | F04D 29/526 |
| 2009/0297331 | A1 | 12/2009 | Caucheteux et al. | |
| 2012/0269619 | A1 * | 10/2012 | Johann | F04D 29/526 415/182.1 |
| 2013/0183149 | A1 | 7/2013 | Weidmann | |
| 2014/0119883 | A1 * | 5/2014 | Kempf | F04D 29/526 415/1 |
| 2014/0212273 | A1 | 7/2014 | Le Borgne | |
| 2015/0086344 | A1 * | 3/2015 | Guemmer | F04D 29/526 415/174.1 |
| 2016/0169017 | A1 * | 6/2016 | Giacche | F04D 29/526 60/805 |
| 2017/0138212 | A1 * | 5/2017 | Morrill | F04D 29/526 |
| 2018/0163562 | A1 | 6/2018 | Khare et al. | |

FOREIGN PATENT DOCUMENTS

| | | | |
|---|---|---|---|
| DE | 2504073 | A1 | 8/1975 |
| DE | 102006048933 | A1 | 4/2008 |
| DE | 102007053135 | A1 | 5/2009 |
| DE | 102007056953 | A1 | 5/2009 |
| DE | 102008037154 | A1 | 2/2010 |
| EP | 2514975 | A1 | 10/2012 |
| FR | 2975735 | A1 | 11/2012 |
| GB | 2477745 | A | 8/2011 |
| JP | 2014109214 | A * | 6/2014 |
| WO | 2012028140 | A1 | 3/2012 |

OTHER PUBLICATIONS

European Search Report dated Oct. 31, 2019 for counterpart European Patent Application No. EP 19181591.9.

* cited by examiner

STRUCTURAL ASSEMBLY FOR A COMPRESSOR OF A FLUID FLOW MACHINE

CROSS-REFERENCE TO A RELATED APPLICATION

This application claims priority to German Application No. 10 2018 116 062.3 filed Jul. 3, 2018, which application is incorporated by reference herein.

The invention relates to a structural subassembly for a compressor of a turbomachine as per the present disclosure.

There is a known practice, in principle, of providing fans and axial compressors of turbomachines with casing structuring, also referred to as "casing treatment". There are a large number of forms of such casing structuring, and these are associated with the main assemblies in a circumferentially symmetrical manner (e.g. in the form of circumferential grooves) or in a circumferentially discrete manner (e.g. in the form of axial grooves). The aim of casing structuring is to extend the stable, i.e. stall- or surge-free, working range of the compressor.

Thus, it is known that the blades of compressors of an engine are subject to non-symmetrical oscillation. One phenomenon that occurs here is known as "rotating stall" (also referred to as "stall flutter"). In the case of rotating stall, unstable local cells, in which the flow separates locally, are formed at the blade tips of the rotor blades. In the rotating reference system, these cells can migrate in the circumferential direction counter to the direction of rotation of the rotor. Rotating stall disadvantageously excites oscillation or vibration in the individual blades, thereby reducing the life of the blades. Blade failure owing to resonance is also possible if the periodic excitations lie within the range of the natural oscillations of the blades.

CN 201190695 Y discloses the provision of different casing structuring along the circumference of a compressor casing.

The invention is based on the object of providing a structural subassembly for a compressor of a turbomachine which implements casing structuring in an effective manner.

This object is achieved by a structural subassembly having features as disclosed herein. Design embodiments are set forth in the description below.

Accordingly, the invention considers a structural subassembly for a compressor of a turbomachine, which has a rotor having a plurality of blades, which extend radially in a flow path of the turbomachine. A compressor casing is provided, which forms a flow path boundary, which delimits the flow path through the turbomachine radially on the outside. The compressor casing has casing structuring adjoining the rotor. Casing structuring structures the flow path boundary, i.e. the wall region of the compressor casing which delimits the flow path, wherein, in principle, any casing structuring known in the prior art can be employed.

According to the present invention, it is envisaged that the compressor casing has a plurality of circumferential segments, which extend in the circumferential direction. In this arrangement, only one or only some of the circumferential segments forms/form casing structuring, while the other circumferential segments are formed without casing structuring. In this context, a circumferential segment is a segment of the compressor casing which extends in the circumferential direction and adjoins the flow path. The individual circumferential segments adjoin one another in the circumferential direction. At least one circumferential segment but not all the circumferential segments forms or form casing structuring, and therefore the compressor casing has variations in respect of the casing structuring.

The invention counteracts rotating stall in an effective manner. The variation provided by the invention in the casing structuring in the circumferential direction, such that only one or only some of the circumferential segments has or have casing structuring, has the effect that the coherence of the rotating stall pattern which forms is disrupted. As a result, incipient local flow separation at the respective blade tips is counteracted. The invention thus suppresses the formation of coherent separation processes at the blade tip and hence suppresses rotor oscillation. This significantly increases the stable working range of the compressor and of the turbomachine overall.

One embodiment of the invention envisages that the compressor casing has an upper casing half and a lower casing half, which each extend over a circumferential range of 180° in the circumferential direction, and that the circumferential segment or the circumferential segments which forms or form casing structuring is or are formed in the upper casing half of the compressor casing.

This aspect of the invention thus envisages implementing casing structuring only in one or more circumferential segments which is or are formed in the upper casing half of the compressor casing. Reliable and effective operation of the compressor into which the structural subassembly is integrated is thereby ensured. This is because the avoidance of casing structuring in the lower casing half of the compressor casing avoids the risk that the casing structuring will be blocked by ice, in which case there is at least temporary loss of functionality.

It should be noted that the statement that the compressor casing has an upper casing half and a lower casing half is a purely geometrical statement, which reveals nothing about the structure of the compressor casing or casing half. The upper casing half is the upper region of the compressor casing and the lower casing half is the lower region of the compressor casing. These can be merely notional regions, with the two regions being separated from one another by a horizontal plane. In this context, the terms "upper" and "lower" take account of the fact that the structural subassembly and the compressor casing are located in the gravitational field of the earth, thereby automatically defining a vertical direction. Starting from a vector pointing downward in accordance with the gravitational field and defining the angle of 0°, the upper casing half extends in an angular range of between 90° and 270° and the lower casing half extends in an angular range of between 270° and 90°.

It should furthermore be noted that in the case where more than one circumferential segment has casing structuring, the circumferential segments with casing structuring can have different casing structuring, although it is of course also possible for identical casing structuring to be provided. Illustrative embodiments provide for a plurality of mutually adjoining circumferential segments with different casing structuring to be formed, e.g. in the upper casing half, or for a plurality of circumferential segments with casing structuring that are separated by regions without casing structuring to be formed.

One embodiment of the invention envisages that the circumferential segments have the same angle of extent in the circumferential direction. However, this is not necessarily the case. In some embodiments of the invention, provision can be made for the extent of the circumferential segments in the circumferential direction, i.e. the angle of extent, to vary.

The sequence of circumferential segments can furthermore be circumferentially symmetrical or circumferentially asymmetrical, wherein circumferential asymmetry means that there are no angles, apart from 0° and 360°, at which the sequence of circumferential segments forms a mirror image of itself when rotated, i.e. leads to an identical overall structuring.

One embodiment of the invention envisages that the compressor casing has precisely two circumferential segments, wherein an upper circumferential segment is formed in the upper casing half and a lower circumferential segment is formed in the lower casing half. In this case, the casing structuring is formed exclusively in the upper circumferential segment. One variant embodiment of this can provide for both circumferential segments to extend over a circumferential angle of 180°. However, this is not necessarily the case. For example, provision can be made for the upper circumferential segment, which forms casing structuring, to extend over more or less than 180° in the circumferential direction, while the lower circumferential segment accordingly extends over less than or more than 180° in the circumferential direction.

To the extent that both circumferential segments extend over a circumferential angle of 180°, the two circumferential segments of the compressor casing are formed at least approximately as half cylinders.

According to one embodiment of the invention, the compressor casing is formed by a casing divided into two, which has two parts that each extend over 180° in the circumferential direction. A compressor casing of this kind is also referred to as a "split casing". In the case where the compressor casing is formed by a casing divided into two, it is particularly expedient that the compressor casing have two circumferential segments with a circumferential angle of 180° in each case, wherein the parting plane between the two parts of the compressor casing simultaneously forms the boundary between the two circumferential segments with and without casing structuring. However, it is also possible to envisage two circumferential segments with a circumferential angle of 180° in each case being formed on compressor casings which are not divided into two.

Another embodiment of the invention envisages that at least one circumferential segment of the compressor casing has an abradable lining. Here, the abradable lining forms the flow path boundary of the compressor casing. In the sense according to the present invention, the abradable lining is part of the compressor casing. The use of an abradable lining, also referred to as abradable coating or "liner", allows narrow running clearances between the tips of the rotor blades and the surrounding casing, thereby making it possible to achieve good compressor performance figures.

A large number of variants is possible here. According to one variant, at least one circumferential segment which has casing structuring has an abradable lining, wherein the casing structuring is formed in the abradable lining. This is associated with the advantage that the casing structuring may be implemented not on the actual compressor casing (i.e. in the metallic casing wall of the compressor casing) but on the abradable lining. It is thereby possible to implement casing structuring in a simple manner.

At the same time, provision can be made for the upper circumferential segment to have an abradable lining which forms casing structuring, and the lower circumferential segment to form an abradable lining without casing structuring. As a result, narrow running clearances are achieved between the blade tips and the flow path boundary along the entire circumference of the compressor casing.

Another variant envisages that only the circumferential segment or only the circumferential segments which do not form casing structuring has or have an abradable lining, while the casing structuring is formed on the actual compressor casing, i.e. in the casing wall of the compressor casing.

In the case where only one or only some of the circumferential segments has or have an abradable lining, provision can be made for the circumferential segments to have two different casing radii (wherein the casing radius is based on the casing wall of the actual compressor casing and not on the radius of the abradable lining). In this case, the casing radius of a circumferential segment which has an abradable lining is larger than the casing radius of a circumferential segment which does not have an abradable lining. By means of circumferential segments with different radii, it is possible to ensure that a uniform radius of the radially outer flow path boundary is implemented, despite the fact that an abradable lining is formed in the compressor casing only in partial segments and not over 360°.

In one embodiment, the casing structuring is of circumferentially discrete design and, in this embodiment, has circumferential grooves, for example, which each extend in the circumferential direction, wherein the circumferential grooves are spaced apart in the axial direction.

According to another embodiment, the casing structuring is of circumferentially discrete design. In this embodiment, it has, for example, axial grooves which each extend over a defined length in the axial direction, wherein the axial grooves are spaced apart in the circumferential direction. One variant embodiment thereof envisages that the casing structuring is in the form of half-heart-shaped axial grooves. Casing structuring in the form of half-heart-shaped axial grooves is known, for example, from DE 10 2007 056 953 A1, to which reference is made to this extent.

In other variants, the circumferential grooves or axial grooves are provided with a rectangular or parallelogram-shaped cross section. It is also possible to envisage the casing structuring being accomplished by means of recirculation channels instead of grooves. In this case, it is envisaged that a recirculation channel on the flow path boundary connects two openings to one another, namely a discharge opening to a feed opening provided further upstream. Circulation channels of this kind are known, for example, from DE 10 2008 037 154 A1, to which reference is made to this extent.

The rotor of the structural subassembly considered according to the invention can be a fan, the rotor of a low-pressure compressor, the rotor of an intermediate-pressure compressor or the rotor of a high-pressure compressor. It can be formed by the first stage (compressor inlet stage) or by an embedded stage of the compressor.

In this case, provision can be made for the rotor to be of BLISK-type construction. In the case of rotors of BLISK-type construction, problems arise especially from rotating stall, which is counteracted by the present invention.

One illustrative embodiment envisages that the rotor is a fan of BLISK-type construction.

Another illustrative embodiment envisages that the rotor is a rotor of BLISK-type construction of a compressor inlet stage of a compressor. A compressor inlet stage of this kind furthermore comprises a stator having stator blades, the stagger angle of which is adjustable, said stator being arranged ahead of the first rotor of the compressor. Such a stator is referred to as an inlet stator or pre-stator or as IGV (IGV—"Inlet Guide Vane"). Inlet stators increase the swirl in the flow and improve the working range of a compressor.

In conjunction with the provision of circumferential structuring only in circumferential segments, the working range of the compressor is expanded to a particular degree.

Another embodiment of the invention envisages that the casing structuring is formed in the compressor casing adjoining the leading edge of the rotor blades. In this case, it extends in a region which begins ahead of the leading edge of the rotor blades and ends after the leading edge of the rotor blades, relative to the axial direction.

In another aspect of the invention, the invention makes available a structural subassembly for a compressor of a turbomachine which has:

- a BLISK-type rotor having a plurality of blades, which extend radially in a flow path of the turbomachine,
- a compressor casing, which forms a flow path boundary, which delimits the flow path through the turbomachine radially on the outside, wherein
- the compressor casing has an upper casing half and a lower casing half, which each extend over a circumferential range of 180° in the circumferential direction,
- the compressor casing has casing structuring adjoining the rotor,
- the compressor casing has two circumferential segments, which each extend over a circumferential angle of 180°, wherein an upper circumferential segment is formed in the upper casing half and a lower circumferential segment is formed in the lower casing half,
- wherein the casing structuring is formed exclusively in the upper circumferential segment.

In another aspect of the invention, the invention relates to a gas turbine engine, in particular for an aircraft, having a structural subassembly according to the invention.

Provision may be made here whereby the gas turbine engine has:

- an engine core which comprises a turbine, a compressor having a structural subassembly according to the invention, and a turbine shaft, which is configured as a hollow shaft and connects the turbine to the compressor;
- a fan which is positioned upstream of the engine core, wherein the fan comprises a plurality of fan blades; and
- a gearbox that receives an input from the turbine shaft and outputs drive to the fan so as to drive the fan at a lower rotational speed than the turbine shaft.

One design embodiment to this end can provide that

- the turbine is a first turbine, the compressor is a first compressor, and the turbine shaft is a first turbine shaft;
- the engine core further comprises a second turbine, a second compressor, and a second turbine shaft which connects the second turbine to the second compressor; and
- the second turbine, the second compressor, and the second turbine shaft are arranged so as to rotate at a higher rotational speed than the first turbine shaft.

It is pointed out that the present invention is described with reference to a cylindrical coordinate system which has the coordinates x, r, and φ. Here, x indicates the axial direction, r indicates the radial direction, and φ indicates the angle in the circumferential direction. The axial direction is in this case identical to the machine axis of a gas turbine engine in which the structural subassembly is arranged. Proceeding from the x-axis, the radial direction points radially outward. Terms such as "in front of", "behind", "front", and "rear" refer to the axial direction, or the flow direction in the engine. Terms such as "outer" or "inner" refer to the radial direction.

As noted elsewhere herein, the present disclosure may relate to a gas turbine engine. Such a gas turbine engine may comprise an engine core which comprises a turbine, a combustion chamber, a compressor, and a core shaft that connects the turbine to the compressor. Such a gas turbine engine may comprise a fan (having fan blades) which is positioned upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be performed directly from the core shaft or indirectly from the core shaft, for example via a spur shaft and/or a spur gear. The core shaft may be rigidly connected to the turbine and the compressor, such that the turbine and the compressor rotate at the same rotational speed (wherein the fan rotates at a lower rotational speed).

The gas turbine engine as described and/or claimed herein may have any suitable general architecture. For example, the gas turbine engine may have any desired number of shafts, for example one, two or three shafts, that connect turbines and compressors. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft which connects the second turbine to the second compressor. The second turbine, the second compressor, and the second core shaft may be arranged so as to rotate at a higher rotational speed than the first core shaft.

In such an arrangement, the second compressor may be positioned so as to be axially downstream of the first compressor. The second compressor may be arranged so as to receive (for example directly receive, for example via a generally annular channel) flow from the first compressor.

The gearbox may be arranged so as to be driven by the core shaft (for example the first core shaft in the example above) that is configured to rotate (for example when in use) at the lowest rotational speed. For example, the gearbox can be arranged so as to be driven only by the core shaft (for example only by the first core shaft, and not the second core shaft, in the example above) that is configured to rotate (for example when in use) at the lowest rotational speed. Alternatively thereto, the gearbox can be arranged so as to be driven by one or a plurality of shafts, for example the first and/or the second shaft in the example above.

In the case of a gas turbine engine as described and/or claimed herein, a combustion chamber can be provided axially downstream of the fan and of the compressor(s). For example, the combustion chamber can lie directly downstream of the second compressor (for example at the exit of the latter), when a second compressor is provided. By way of further example, the flow at the exit of the compressor can be provided to the inlet of the second turbine, when a second turbine is provided. The combustion chamber can be provided so as to be upstream of the turbine(s).

The or each compressor (for example the first compressor and the second compressor as described above) can comprise any number of stages, for example multiple stages. Each stage can comprise a row of rotor blades and a row of stator blades, which can be variable stator blades (in the sense that the angle of incidence of said variable stator blades can be variable). The row of rotor blades and the row of stator blades can be axially offset from each other.

The or each turbine (for example the first turbine and the second turbine as described above) can comprise any number of stages, for example multiple stages. Each stage can comprise a row of rotor blades and a row of stator blades. The row of rotor blades and the row of stator blades can be axially offset from each other.

Each fan blade can be defined as having a radial span extending from a root (or a hub) at a radially inner location flowed over by gas, or at a 0% span width position, to a tip at a 100% span width position. The ratio of the radius of the fan blade at the hub to the radius of the fan blade at the tip can be less than (or on the order of): 0.4, 0.39, 0.38, 0.37, 0.36, 0.35, 0.34, 0.33, 0.32, 0.31, 0.3, 0.29, 0.28, 0.27, 0.26 or 0.25. The ratio of the radius of the fan blade at the hub to the radius of the fan blade at the tip can be in an inclusive range delimited by two of the values in the previous sentence (that is to say that the values can form upper or lower limits). These ratios can commonly be referred to as the hub-to-tip ratio. The radius at the hub and the radius at the tip can both be measured at the leading periphery (or the axially frontmost periphery) of the blade. The hub-to-tip ratio refers, of course, to that portion of the fan blade which is flowed over by gas, that is to say the portion that is situated radially outside any platform.

The radius of the fan can be measured between the engine centerline and the tip of the fan blade at the leading periphery of the latter. The diameter of the fan (which can simply be double the radius of the fan) can be larger than (or on the order of): 250 cm (approximately 100 inches), 260 cm, 270 cm (approximately 105 inches), 280 cm (approximately 110 inches), 290 cm (approximately 115 inches), 300 cm (approximately 120 inches), 310 cm, 320 cm (approximately 125 inches), 330 cm (approximately 130 inches), 340 cm (approximately 135 inches), 350 cm, 360 cm (approximately 140 inches), 370 cm (approximately 145 inches), 380 cm (approximately 150 inches), or 390 cm (approximately 155 inches). The fan diameter can be in an inclusive range delimited by two of the values in the previous sentence (that is to say that the values can form upper or lower limits).

The rotational speed of the fan can vary when in use. Generally, the rotational speed is lower for fans with a comparatively large diameter. Purely by way of non-limiting example, the rotational speed of the fan at cruise conditions can be less than 2500 rpm, for example less than 2300 rpm. Purely by way of further non-limiting example, the rotational speed of the fan at cruise conditions for an engine having a fan diameter in the range from 250 cm to 300 cm (for example 250 cm to 280 cm) can also be in the range from 1700 rpm to 2500 rpm, for example in the range from 1800 rpm to 2300 rpm, for example in the range from 1900 rpm to 2100 rpm. Purely by way of further non-limiting example, the rotational speed of the fan at cruise conditions for an engine having a fan diameter in the range from 320 cm to 380 cm can be in the range from 1200 rpm to 2000 rpm, for example in the range from 1300 rpm to 1800 rpm, for example in the range from 1400 rpm to 1600 rpm.

During use of the gas turbine engine, the fan (with associated fan blades) rotates about an axis of rotation. This rotation results in the tip of the fan blade moving with a speed $U_{tip}$. The work done by the fan blades on the flow results in an enthalpy rise dH in the flow. A fan tip loading can be defined as $dH/U_{tip}^2$, where dH is the enthalpy rise (for example the 1-D average enthalpy rise) across the fan and $U_{tip}$ is the (translational) velocity of the fan tip, for example at the leading periphery of the tip (which can be defined as the fan tip radius at the leading periphery multiplied by the angular speed). The fan tip loading at cruise conditions can be more than (or on the order of): 0.3, 0.31, 0.32, 0.33, 0.34, 0.35, 0.36, 0.37, 0.38, 0.39, or 0.4 (wherein all units in this passage are $Jkg^{-1}K^{-1}/(ms^{-1})^2$). The fan tip loading can be in an inclusive range delimited by two of the values in the previous sentence (that is to say that the values can form upper or lower limits).

Gas turbine engines in accordance with the present disclosure can have any desired bypass ratio, where the bypass ratio is defined as the ratio of the mass flow rate of the flow through the bypass duct to the mass flow rate of the flow through the core at cruise conditions. In the case of some arrangements, the bypass ratio can be more than (or on the order of): 10, 10.5, 11, 11.5, 12, 12.5, 13, 13.5, 14, 14.5, 15, 15.5, 16, 16.5, or 17. The bypass ratio can be in an inclusive range delimited by two of the values in the previous sentence (that is to say that the values can form upper or lower limits). The bypass duct can be substantially annular. The bypass duct can be situated radially outside the engine core. The radially outer surface of the bypass duct can be defined by an engine nacelle and/or a fan casing.

The overall pressure ratio of a gas turbine engine as described and/or claimed herein can be defined as the ratio of the stagnation pressure upstream of the fan to the stagnation pressure at the exit of the highest pressure compressor (before entry into the combustion chamber). By way of non-limiting example, the overall pressure ratio of a gas turbine engine as described and/or claimed herein at cruising speed can be greater than (or on the order of): 35, 40, 45, 50, 55, 60, 65, 70, 75. The overall pressure ratio can be in an inclusive range delimited by two of the values in the previous sentence (that is to say that the values can form upper or lower limits).

The specific thrust of an engine can be defined as the net thrust of the engine divided by the total mass flow through the engine. The specific thrust of an engine as described and/or claimed herein at cruise conditions can be less than (or on the order of): 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust can be in an inclusive range delimited by two of the values in the previous sentence (that is to say that the values can form upper or lower limits). Such engines can be particularly efficient in comparison with conventional gas turbine engines.

A gas turbine engine as described and/or claimed herein can have any desired maximum thrust. Purely by way of non-limiting example, a gas turbine as described and/or claimed herein can be capable of generating a maximum thrust of at least (or on the order of): 160 kN, 170 kN, 180 kN, 190 kN, 200 kN, 250 kN, 300 kN, 350 kN, 400 kN, 450 kN, 500 kN, or 550 kN. The maximum thrust can be in an inclusive range delimited by two of the values in the previous sentence (that is to say that the values can form upper or lower limits). The thrust referred to above can be the maximum net thrust at standard atmospheric conditions at sea level plus 15 degrees C. (ambient pressure 101.3 kPa, temperature 30 degrees C.), at a static engine.

In use, the temperature of the flow at the entry to the high pressure turbine can be particularly high. This temperature, which can be referred to as TET, can be measured at the exit to the combustion chamber, for example directly upstream of the first turbine blade, which in turn can be referred to as a nozzle guide blade. At cruising speed, the TET can be at least (or on the order of): 1400K, 1450K, 1500K, 1550K, 1600K, or 1650K. The TET at cruising speed can be in an inclusive range delimited by two of the values in the previous sentence (that is to say that the values can form upper or lower limits). The maximum TET in the use of the engine can be at least (or on the order of), for example: 1700K, 1750K, 1800K, 1850K, 1900K, 1950K, or 2000K. The maximum TET can be in an inclusive range delimited by two of the values in the previous sentence (that is to say that the values can form upper or lower limits). The maximum TET can occur, for example, at a high thrust condition, for example at a maximum take-off thrust (MTO) condition.

A fan blade and/or an airfoil portion of a fan blade described and/or claimed herein can be manufactured from any suitable material or a combination of materials. For example, at least a part of the fan blade and/or of the airfoil can be manufactured at least in part from a composite, for example a metal matrix composite and/or an organic matrix composite, such as carbon fiber. By way of further example, at least a part of the fan blade and/or of the airfoil can be manufactured at least in part from a metal, such as a titanium-based metal or an aluminum-based material (such as an aluminum-lithium alloy) or a steel-based material. The fan blade can comprise at least two regions which are manufactured using different materials. For example, the fan blade can have a protective leading periphery, which is manufactured using a material that is better able to resist impact (for example of birds, ice, or other material) than the rest of the blade. Such a leading periphery can, for example, be manufactured using titanium or a titanium-based alloy. Thus, purely by way of example, the fan blade can have a carbon-fiber-based or aluminum-based body (such as an aluminum-lithium alloy) with a titanium leading periphery.

A fan as described and/or claimed herein can comprise a central portion, from which the fan blades can extend, for example in a radial direction. The fan blades can be attached to the central portion in any desired manner. For example, each fan blade can comprise a fixing device which can engage with a corresponding slot in the hub (or disk). Purely by way of example, such a fixing device can be in the form of a dovetail that can be inserted into and/or engage with a corresponding slot in the hub/disk in order for the fan blade to be fixed to the hub/disk. By way of further example, the fan blades can be formed integrally with a central portion. Such an arrangement can be referred to as a blisk or a bling. Any suitable method can be used to manufacture such a blisk or bling. For example, at least a part of the fan blades can be machined from a block and/or at least a part of the fan blades can be attached to the hub/disk by welding, such as linear friction welding, for example.

The gas turbine engines described and/or claimed herein may or may not be provided with a variable area nozzle (VAN). Such a variable area nozzle can allow the exit cross section of the bypass duct to be varied when in use. The general principles of the present disclosure can apply to engines with or without a VAN.

The fan of a gas turbine as described and/or claimed herein can have any desired number of fan blades, for example 16, 18, 20, or 22 fan blades.

As used herein, cruise conditions can mean cruise conditions of an aircraft to which the gas turbine engine is attached. Such cruise conditions can be conventionally defined as the conditions at mid-cruise, for example the conditions experienced by the aircraft and/or the engine between (in terms of time and/or distance) the top of climb and the start of descent.

Purely by way of example, the forward speed at the cruise condition can be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any arbitrary speed within these ranges can be the constant cruise condition. In the case of some aircraft, the constant cruise conditions can be outside these ranges, for example below Mach 0.7 or above Mach 0.9.

Purely by way of example, the cruise conditions can correspond to standard atmospheric conditions at an altitude that is in the range from 10,000 m to 15,000 m, for example in the range from 10,000 m to 12,000 m, for example in the range from 10,400 m to 11,600 m (around 38,000 ft), for example in the range from 10,500 m to 11,500 m, for example in the range from 10,600 m to 11,400 m, for example in the range from 10,700 m (around 35,000 ft) to 11,300 m, for example in the range from 10,800 m to 11,200 m, for example in the range from 10,900 m to 11,100 m, for example on the order of 11,000 m. The cruise conditions can correspond to standard atmospheric conditions at any given altitude in these ranges.

Purely by way of example, the cruise conditions can correspond to the following: a forward Mach number of 0.8; a pressure of 23,000 Pa; and a temperature of −55 degrees C.

As used anywhere herein, "cruising speed" or "cruise conditions" can mean the aerodynamic design point. Such an aerodynamic design point (or ADP) can correspond to the conditions (including, for example, the Mach number, environmental conditions, and thrust requirement) for which the fan operation is designed. This can mean, for example, the conditions at which the fan (or the gas turbine engine) has optimum efficiency in terms of construction.

In use, a gas turbine engine described and/or claimed herein can operate at the cruise conditions defined elsewhere herein. Such cruise conditions can be determined by the cruise conditions (for example the mid-cruise conditions) of an aircraft to which at least one (for example 2 or 4) gas turbine engine can be fastened in order to provide the thrust force.

It is self-evident to a person skilled in the art that a feature or parameter described in relation to any one of the above aspects may be applied to any other aspect, unless they are mutually exclusive. Furthermore, any feature or any parameter described here may be applied to any aspect and/or combined with any other feature or parameter described here, unless they are mutually exclusive.

The invention will be explained in more detail hereunder by means of a plurality of exemplary embodiments with reference to the figures of the drawing. In the drawing.

Figure 1:
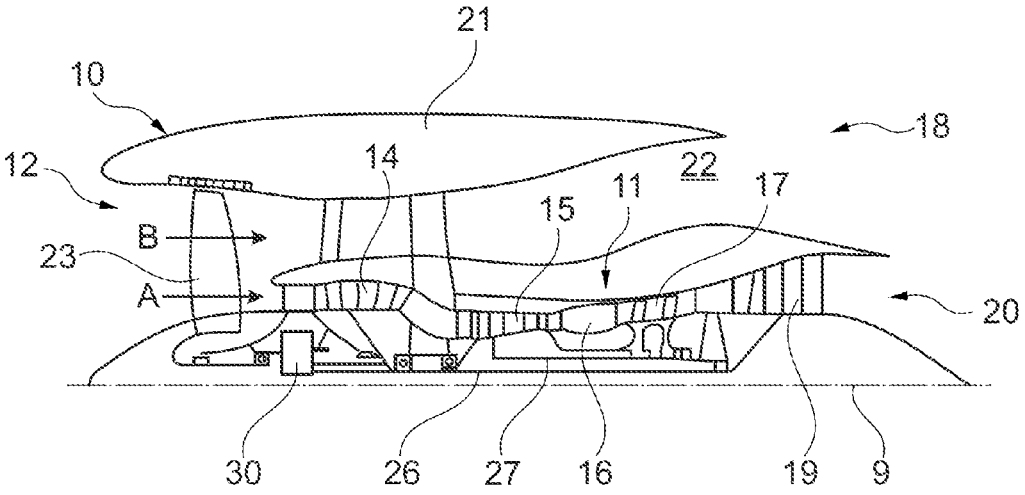
FIG. 1 shows a sectional lateral view of a gas turbine engine.

FIG. 1 illustrates a gas turbine engine 10 having a main axis of rotation 9. The engine 10 comprises an air intake 12 and a thrust fan 23 that generates two airflows: a core airflow A and a bypass airflow B. The gas turbine engine 10 comprises a core 11 which receives the core airflow A. In the sequence of axial flow, the engine core 11 comprises a low-pressure compressor 14, a high-pressure compressor 15, a combustion installation 16, a high-pressure turbine 17, a low-pressure turbine 19, and a core thrust nozzle 20. An engine nacelle 21 surrounds the gas turbine engine 10 and defines a bypass duct 22 and a bypass thrust nozzle 18. The bypass airflow B flows through the bypass duct 22. The fan 23 is attached to and driven by the low pressure turbine 19 by way of a shaft 26 and an epicyclic gearbox 30.

During use, the core airflow A is accelerated and compressed by the low-pressure compressor 14 and directed into the high-pressure compressor 15, where further compression takes place. The compressed air exhausted from the high-pressure compressor 15 is directed into the combustion device 16, where it is mixed with fuel and the mixture is combusted. The resultant hot combustion products then expand through the high-pressure and low-pressure turbines 17, 19 and as a result drive the latter, before being exhausted through the nozzle 20 to provide some propulsive thrust. The high-pressure turbine 17 drives the high-pressure compressor 15 by means of a suitable connecting shaft 27. The fan 23 generally provides the majority of the thrust force. The epicyclic gearbox 30 is a reduction gearbox.

Figure 2:
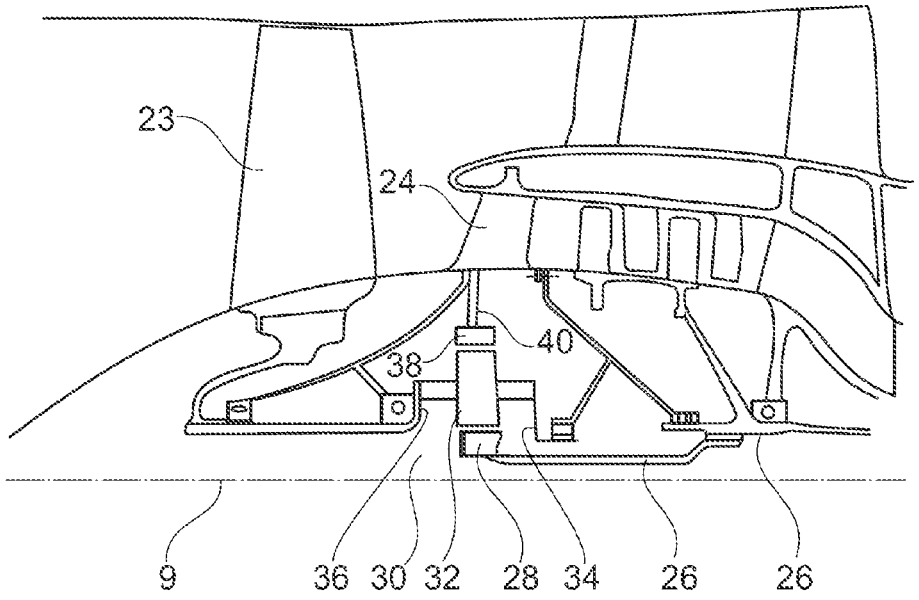
FIG. 2 shows a close-up sectional lateral view of an upstream portion of a gas turbine engine.

An exemplary assembly for a gearbox fan gas turbine engine 10 is shown in FIG. 2. The low-pressure turbine 19 (see FIG. 1) drives the shaft 26, which is coupled to a sun gear 28 of the epicyclic gearbox assembly 30. Radially to the outside of the sun gear 28 and meshing therewith are a plurality of planet gears 32 that are coupled to one another by a planet carrier 34. The planet carrier 34 limits the planet gears 32 to orbiting around the sun gear 28 in a synchronous manner whilst enabling each planet gear 32 to rotate about its own axis. The planet carrier 34 is coupled by way of linkages 36 to the fan 23 so as to drive the rotation of the latter about the engine axis 9. Radially to the outside of the planet gears 32 and meshing therewith is an annulus or ring gear 38 that is coupled, via linkages 40, to a stationary supporting structure 24.

It is noted that the terms "low-pressure turbine" and "low-pressure compressor" as used herein may be taken to mean the lowest pressure turbine stage and the lowest pressure compressor stage (that is to say not including the fan 23) respectively and/or the turbine and compressor stages that are connected to one another by the connecting shaft 26 with the lowest rotating speed in the engine (that is to say not including the gearbox output shaft that drives the fan 23). In some literature, the "low-pressure turbine" and "low-pressure compressor" referred to herein may alternatively be known as the "intermediate pressure turbine" and "intermediate-pressure compressor". Where such alternative nomenclature is used, the fan 23 can be referred to as a first compression stage or lowest-pressure compression stage.

Figure 3:
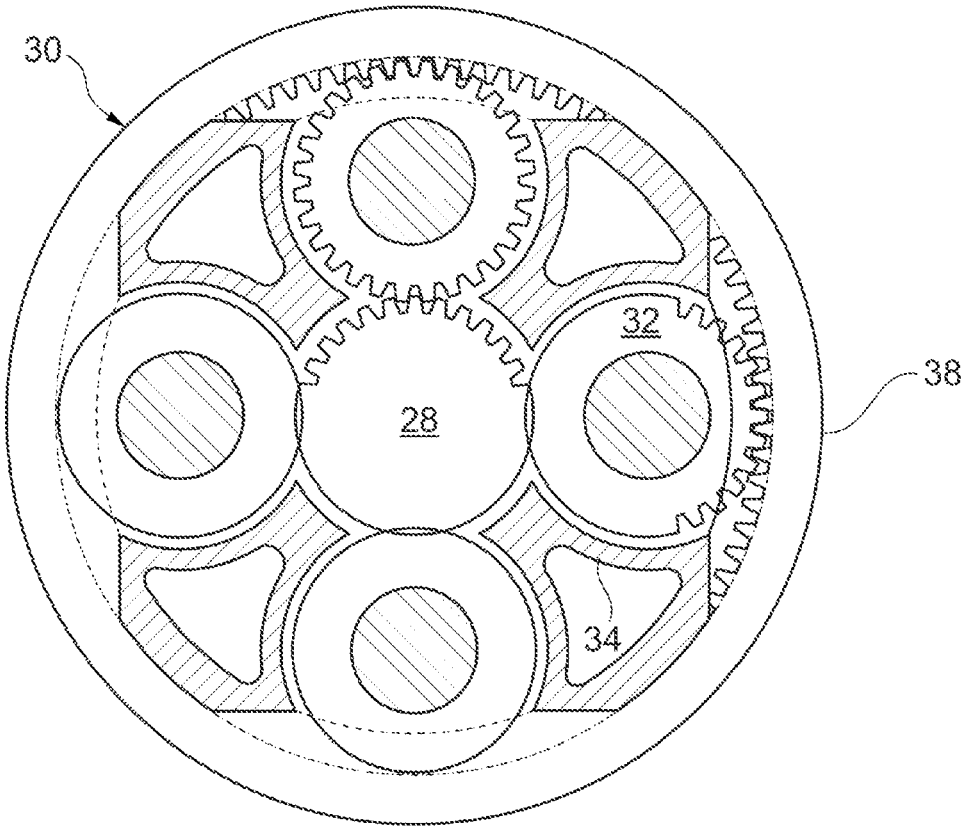
FIG. 3 shows a partially cut-away view of a gearbox for a gas turbine engine.

The epicyclic gearbox 30 is shown in an exemplary manner in greater detail in FIG. 3. Each of the sun gear 28, the planet gears 32 and the ring gear 38 comprise teeth about their periphery to mesh with the other gears. However, for clarity, only exemplary portions of the teeth are illustrated in FIG. 3. There are four planet gears 32 illustrated, although it will be apparent to the person skilled in the art that more or fewer planet gears 32 can be provided within the scope of protection of the claimed invention. Practical applications of an epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, wherein the ring gear 38 is fixed. However, any other suitable type of epicyclic gearbox 30 can be used. By way of further example, the epicyclic gearbox 30 can be a star arrangement, in which the planet carrier 34 is held so as to be fixed, wherein the ring gear (or annulus) 38 is allowed to rotate. In the case of such an arrangement, the fan 23 is driven by the ring gear 38. By way of further alternative example, the gearbox 30 can be a differential gearbox in which the ring gear 38 and the planet carrier 34 are both allowed to rotate.

It goes without saying that the arrangement shown in FIGS. 2 and 3 is merely an example, and various alternatives fall within the scope of protection of the present disclosure. Purely by way of example, any suitable arrangement can be used for positioning the gearbox 30 in the engine 10 and/or for connecting the gearbox 30 to the engine 10. By way of further example, the connections (such as the linkages 36, 40 in the example of FIG. 2) between the gearbox 30 and other parts of the engine 10 (such as the input shaft 26, the output shaft and the fixed structure 24) can have a certain degree of stiffness or flexibility. By way of further example, any suitable arrangement of the bearings between rotating and stationary parts of the engine (for example between the input and output shafts of the gearbox and the fixed structures, such as the gearbox casing) can be used, and the disclosure is not limited to the exemplary arrangement of FIG. 2. For example, where the gearbox 30 has a star arrangement (described above), the person skilled in the art would readily understand that the arrangement of output and support linkages and bearing positions would typically be different to that shown by way of example in FIG. 2.

Accordingly, the present disclosure extends to a gas turbine engine having an arbitrary arrangement of gearbox types (for example star-shaped or planetary), support structures, input and output shaft arrangement, and bearing positions.

Optionally, the gearbox can drive additional and/or alternative components (e.g. the intermediate pressure compressor and/or a booster compressor).

Other gas turbine engines to which the present disclosure can be applied can have alternative configurations. For example, engines of this type can have an alternative number of compressors and/or turbines and/or an alternative number of connecting shafts. By way of further example, the gas turbine engine shown in FIG. 1 has a split flow nozzle 20, 22, meaning that the flow through the bypass duct 22 has its own nozzle that is separate to and radially outside the core engine nozzle 20. However, this is not limiting, and any aspect of the present disclosure can also apply to engines in which the flow through the bypass duct 22 and the flow through the core 11 are mixed or combined before (or upstream of) a single nozzle, which can be referred to as a mixed flow nozzle. One or both nozzles (whether mixed or split flow) can have a fixed or variable area.

Whilst the example described relates to a turbofan engine, the disclosure can be applied, for example, to any type of gas turbine engine, such as, for example, an open rotor engine (in which the fan stage is not surrounded by an engine nacelle) or a turboprop engine. In some arrangements, the gas turbine engine 10 may not comprise a gearbox 30.

The geometry of the gas turbine engine 10, and components thereof, is/are defined by a conventional axis system, comprising an axial direction (which is aligned with the rotational axis 9), a radial direction (in the bottom-to-top direction in FIG. 1), and a circumferential direction (perpendicular to the view in FIG. 1). The axial, radial and circumferential directions are mutually perpendicular.

In the context of the present invention, the design of casing structuring in the compressor casing is significant. Here, the invention can fundamentally be implemented in the fan stage, in a low-pressure compressor, an intermediate-pressure compressor (where present) and/or a high-pressure compressor.

Figure 4:
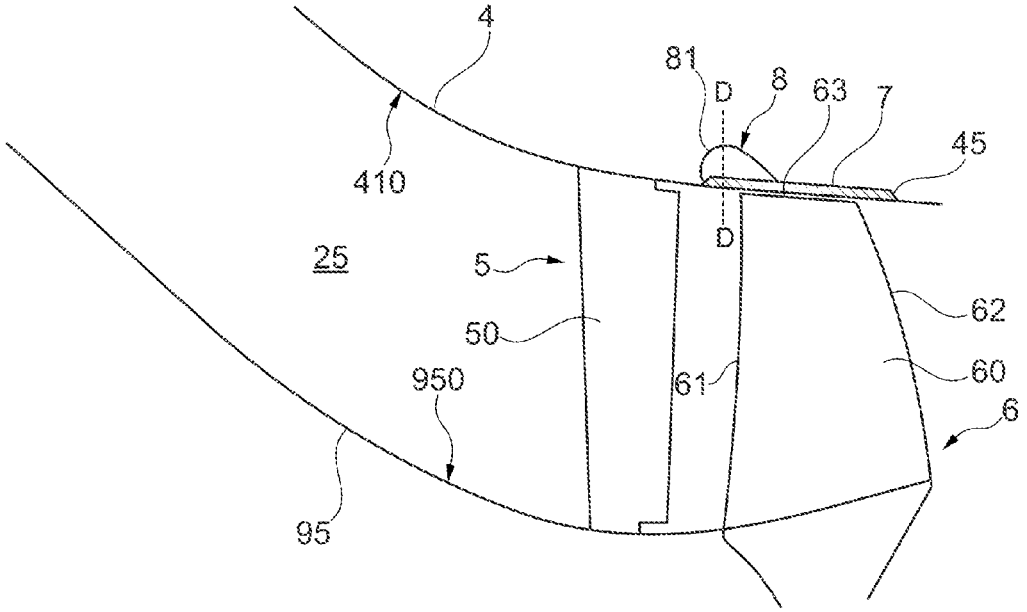
FIG. 4 shows schematically a structural subassembly, which has an inlet stator, a rotor and a compressor casing having casing structuring.

FIG. 4 shows, in a sectional view, a structural subassembly, which defines a flow path 25 and an inlet stator 5, a rotor 6 and flow path boundaries. The flow path 25 guides the core air flow A as per FIG. 1 through the core engine.

Radially on the inside, the flow path 25 is delimited by inner wall or hub structures 95, which form an inner flow path boundary 950. Radially on the outside, the flow path 25 is delimited by a compressor casing 4, which forms a radially outer flow path boundary 410. In the illustrative embodiment shown, but not necessarily, the structural subassembly is situated in the region of the first stage of a compressor. In this case, the compressor comprises the inlet stator 5, which has stator blades 50 with a variable stagger angle. The swirl in the flow is increased by the inlet stator 5 and, as a result, the downstream rotor 6 is driven more effectively.

The rotor 6 comprises a row of rotor blades 60, which extend radially in the flow path 25. The rotor blades 60 have a leading edge 61, a trailing edge 62 and a blade tip 63. A gap is formed between the blade tip 63 and the compressor casing 4.

To minimize this gap, an abradable lining 7 is integrated into the compressor casing 4. The casing wall of the compressor casing 4 which faces the flow path 25 forms a corresponding recess 45 for this purpose. On its side facing the flow path 25, the abradable lining 7 forms the flow path boundary 410. On its radially outer side, the abradable lining 7 is secured in the recess 45.

Casing structuring 8 is integrated into the abradable lining 7. In the illustrative embodiment shown, this is implemented by axial grooves 81 in a half heart shape. An axial groove 81 of this kind in a half heart shape 81 is illustrated schematically in FIG. 4. However, the illustration should not be taken to mean that the casing structuring 8 projects in a radial direction from the abradable lining 7. The illustration serves merely to indicate the axial course of the axial groove 81 in a half heart shape.

Figure 5:
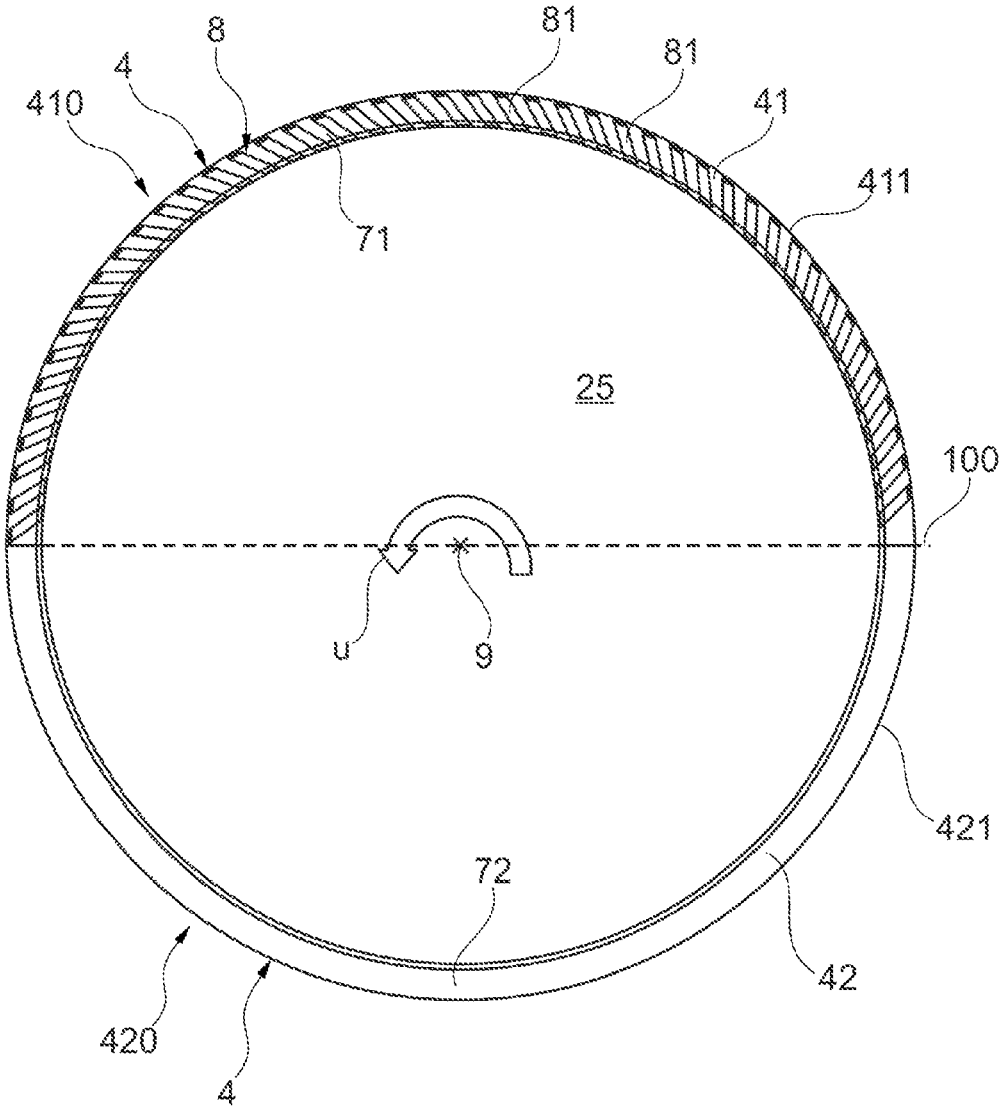
FIG. 5 shows a section perpendicular to the axial direction along the line D-D in FIG. 4.

A greater understanding of the structure of the casing structuring 8 will be obtained from FIG. 5, which shows a sectional view through a compressor casing 4 and an abradable lining 7 in a plane perpendicular to the axial direction, which is defined by the machine axis 9 (along the line D-D in FIG. 4). The direction of rotation of the rotor 6 is denoted by u.

First of all, attention is drawn, by way of terminology, to the fact that the compressor casing 4 has an upper compressor casing 410 and a lower compressor casing 420. Here, the upper compressor casing 410 and the lower compressor casing 420 indicate spatial regions of the compressor casing 4. These are separated from one another by the horizontal plane 100. In principle, the upper compressor casing 410 and the lower compressor casing 420 can be formed by any structures.

As illustrated in FIG. 5, the compressor casing comprises an upper circumferential segment 41 and a lower circumferential segment 42. The circumferential segments 41, 42 adjoin the flow path 25. In the illustrative embodiment shown, the upper circumferential segment 41 extends in the region of the upper compressor casing 410, although this is not necessarily the case. The lower circumferential segment 42 extends in the region of the lower compressor casing 420.

At any rate, the circumferential segments 41, 42 differ in that only one of the circumferential segments forms casing structuring. Thus, it is envisaged that only the upper circumferential segment 41 has casing structuring 8, while the lower circumferential segment 42 does not have casing structuring.

As explained with reference to FIG. 4, the casing structuring in the illustrative embodiment shown is formed in the abradable lining, although this is not necessarily the case. Accordingly, the casing 4 has an upper abradable lining 71, in which casing structuring 8 is implemented, and a lower abradable lining 72, which is implemented without casing structuring. The two abradable linings 71, 72 each extend over 180° in the circumferential direction and adjoin one another in the horizontal plane 100. In this arrangement, provision can be made for the casing 4 to be a split casing, which has two casing halves 411, 421, wherein the parting plane (i.e. the horizontal plane 100) between the two casing halves 411, 421 also forms the boundary between the two circumferential segments 41, 42 and abradable linings 71, 72.

According to one illustrative embodiment, the upper abradable lining 71, in which casing structuring 8 is implemented, and the lower abradable lining 72, which is implemented without casing structuring, are composed of the material Metco 601NS, Metco 320NS or Metco 314NS produced by Oerlikon Metco Switzerland in 8808 Pfäffikon, Switzerland. Metco 601NS is a mixture of silicon-aluminum powders and polyester powders. Metco 320NS is an aluminum-silicon boron nitride powder. Metco 314NS is a thermal spraying powder composed of a nickel-chromium-aluminum-bentonite mixture.

As an alternative, plastics suitable for high temperatures, porous materials or metallic honeycomb structures are employed as a material for the abradable linings 71, 72.

The radial thickness of the upper abradable lining 71 and the radial thickness of the lower abradable lining 72 are at any rate identical in the illustrative embodiments of the invention.

In accordance with the terminology used, the abradable linings 71, 72 are part of the compressor casing 4. In FIG. 5, the circumferential segments 41, 42, which are provided only partially with casing structuring, are formed by the abradable linings 71, 72 or at any rate comprise these abradable linings 71, 72. As an alternative, provision can be made for the circumferential segment 41, 42 to be formed by the actual compressor casing, i.e. by that wall of the compressor casing which faces the flow path 25. In the case of casing structuring, the corresponding structures, e.g. axial grooves, are formed directly in the casing wall.

In FIG. 5, the axial grooves 81 in a half heart shape are also illustrated in section. As explained, the axial course of said axial grooves 81 in a half heart shape is illustrated in FIG. 4. According to FIG. 5, the axial grooves 81 slope slightly in relation to the radial direction. This can take place in one or the other circumferential direction. The axial grooves 81 can also extend precisely in the radial direction.

In a modification of the illustrative embodiment in FIGS. 4 and 5, an abradable lining 72 is provided only in the lower circumferential segment 72. In this case, the casing structuring 8 is not implemented in an upper abradable lining but in an upper circumferential segment 41, which is implemented by the casing wall of the compressor casing. To ensure that the flow path 25 does not have a change in cross section in such a case, provision can be made for the casing 4 to have a larger casing radius in the lower compressor casing 420 than in the upper compressor casing 410 along the axial region in which it accommodates the lower abradable lining 72.

In another modification of the illustrative embodiment in FIGS. 4 and 5, neither the upper casing half 410 nor the lower casing half 420 has an abradable lining. In the upper casing half, a circumferential segment with casing structuring is formed. In the lower casing half, a circumferential segment without casing structuring is formed.

Figure 6:
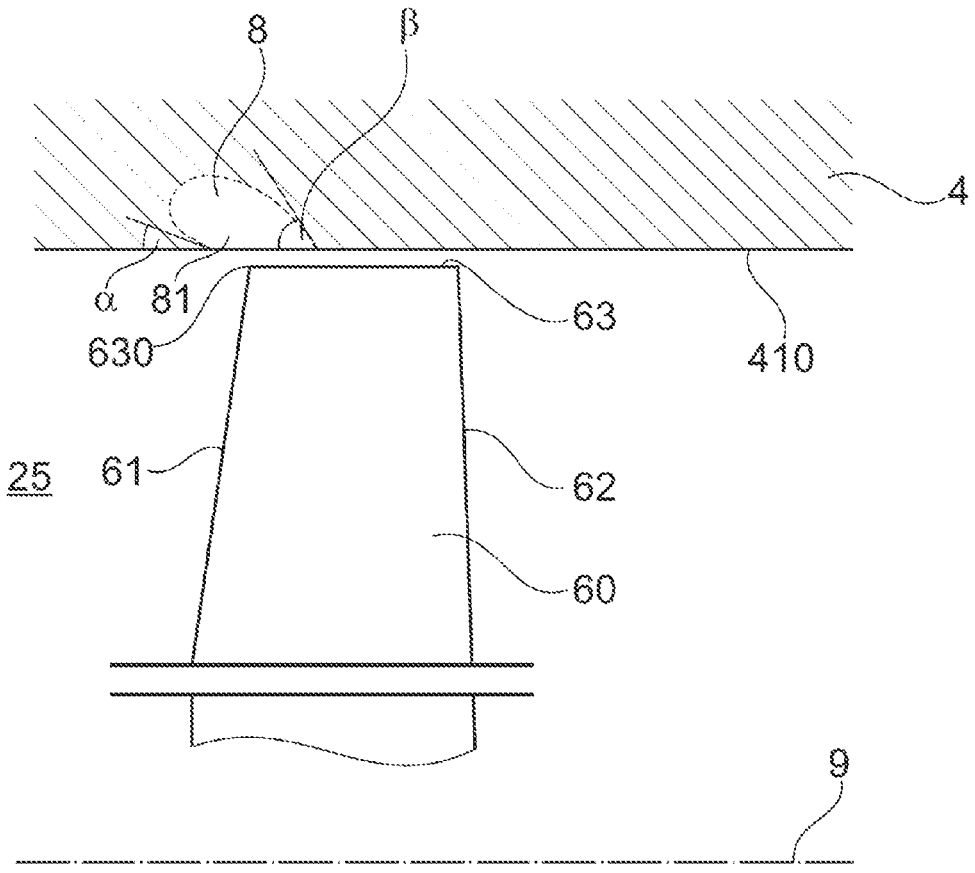
FIG. 6 shows an illustrative embodiment of an axial groove, which is in the form of a half-heart-shaped groove.

FIG. 6 shows another illustrative embodiment of a structural subassembly in accordance with the present invention. In accordance with the description in FIG. 4, the structural subassembly comprises a compressor casing 4, which forms a flow path boundary 410. A rotor 6 comprises rotor blades 60, which each have a leading edge 61, a trailing edge 62 and a blade tip 63. It can be seen that a gap is formed between the blade tip 63 and the flow path boundary 410. The machine axis 9 is likewise illustrated.

In the case of the illustrative embodiment in FIG. 6, casing structuring 8 without the use of an abradable lining is formed directly in the casing wall of the compressor casing 4. As in the case of the illustrative embodiment in FIGS. 4 and 5, the casing structuring is formed by axial grooves 81 in a half heart shape. Such axial grooves in a half heart shape are described in DE 10 2007 056 953 A1, to which reference is made to this extent.

Accordingly, the axial groove 81 in a half heart shape can furthermore be defined by two angles $\alpha$, $\beta$. These create the initial region and the end region of the cross-sectional curve defined by the half heart shape. In this case, the legs of the angle are tangential to the initial and end profile of curve. The angle $\alpha$ is in a range between 20° and 70° to the wall of the compressor casing, for example, and the angle $\beta$ is in a range between 30° and 80° to the wall of the compressor casing, for example.

FIG. 6 furthermore shows that, in the illustrative embodiments of the invention, the casing structuring 8 is formed in the region of the leading edge 61 of the rotor blades 60 of the rotor 6. In this case, the axial extent of the axial grooves 81 is chosen in such a way that, starting from the leading edge 630 of the blade tip 63, the axial grooves 81 extend by a certain length of extent counter to the axial direction and, starting from the leading edge 630, extend by a certain length of extent in the axial direction. Here, the length of extent in the two directions stated is a maximum of 50% of the axial length of the blade tip 63, for example. Such an axial extent of the casing structuring can also be provided in the case of casing structuring formed in a different way.

It is self-evident that the invention is not limited to the embodiments described above and that various modifications and improvements may be made without departing from the concepts described herein. For example, different segmental division of the compressor casing can be provided.

It is furthermore pointed out that any of the features described can be used separately or in combination with any other features, unless they are mutually exclusive. The disclosure also extends to and comprises all combinations and sub-combinations of one or a plurality of features which are described here. If ranges are defined, said ranges thus comprise all of the values within said ranges as well as all of the partial ranges that lie in a range.

The invention claimed is:

1. A structural subassembly for a compressor of a turbomachine, comprising:

a rotor having a plurality of blades, which extend radially in a flow path of the turbomachine, and a compressor casing, which forms a flow path boundary, which radially outwardly delimits the flow path through the turbomachine, the compressor casing including casing structuring adjoining the rotor, wherein the compressor casing includes a plurality of circumferential segments, which extend in a circumferential direction, wherein only one or only some of the circumferential segments forms or form the casing structuring;

wherein at least one of the circumferential segments includes an abradable lining forming a portion of the flow path boundary and at least one of the circumferential segments does not have an abradable lining;

wherein the at least one of the circumferential segments that includes the abradable lining includes a first radially inwardly facing surface on which the abradable lining is applied such that abradable lining forms a first portion of the flow path boundary;

wherein the at least one of the circumferential segments that does not have the abradable lining includes a second radially inwardly facing surface forming a second portion of the flow path boundary;

the second radially inwardly facing surface axially overlapping with the first radially inwardly facing surface;

wherein, a radius of the first radially inwardly facing surface is larger than a radius of the second radially inwardly facing surface to accommodate a thickness of the abradable lining.

2. The structural subassembly according to claim 1, wherein the compressor casing has an upper casing half and a lower casing half, which each extend over a circumferential range of 180° in the circumferential direction, and the only one or only some of the circumferential segments which forms or form casing structuring is or are formed in the upper casing half of the compressor casing.

3. The structural subassembly according to claim 2, wherein the compressor casing has precisely two circumferential segments, an upper circumferential segment and a lower circumferential segment, wherein the upper circumferential segment is formed in the upper casing half and the lower circumferential segment is formed in the lower casing half, and wherein the casing structuring is formed in the upper circumferential segment.

4. The structural subassembly according to claim 3, wherein each of the two circumferential segments extends over a circumferential angle of 180°.

5. The structural subassembly according to claim 1, wherein the circumferential segments have a same angle of extent in the circumferential direction.

6. The structural subassembly according to claim 1, wherein a sequence of the circumferential segments is circumferentially asymmetrical in the circumferential direction.

7. The structural subassembly according to claim 1, wherein the casing structuring is formed in the abradable lining.

8. The structural subassembly according to claim 3, wherein the at least one of the circumferential segments that includes the abradable lining is either the upper circumferential segment or the lower circumferential segment.

9. The structural subassembly according to claim 1, wherein the compressor casing is formed by a casing divided into two, which has two parts that each extend over 180° in the circumferential direction.

10. The structural subassembly according to claim 1, wherein the casing structuring is of circumferentially discrete design.

11. The structural subassembly according to claim 1, wherein the casing structuring is formed as half-heart-shaped axial grooves.

12. The structural subassembly according to claim 1, wherein the casing structuring is formed in the compressor casing adjoining leading edges of the rotor blades.

13. The structural subassembly according to claim 1, wherein the rotor is of BLISK typo construction.

14. The structural subassembly according to claim 1, wherein the rotor is a BLISK rotor of a compressor inlet stage of a compressor.

15. A structural subassembly for a compressor of a turbomachine, comprising:

a BLISK rotor having a plurality of blades, which extend radially in a flow path of the turbomachine, a compressor casing, which forms a flow path boundary, which radially outwardly delimits the flow path through the turbomachine, the compressor casing having an upper casing half and a lower casing half, which each extend over a circumferential range of 180° in a circumferential direction, the compressor casing including casing structuring adjoining the rotor, the compressor casing including precisely two circumferential segments, which each extend over a circumferential angle of 180°, wherein an upper circumferential segment is formed in the upper casing half and a lower circumferential segment is formed in the lower casing half, wherein the casing structuring is formed exclusively in the upper circumferential segment;

wherein a first one of the two circumferential segments includes an abradable lining forming a portion of the flow path boundary and a second one of the two circumferential segments does not have an abradable lining;

wherein the first one of the two circumferential segments includes a first radially inwardly facing surface on which the abradable lining is applied such that abradable lining forms a first portion of the flow path boundary;

wherein the at least one of the circumferential segments that does not have the abradable lining includes a second radially inwardly facing surface forming a second portion of the flow path boundary;

the second radially inwardly facing surface axially overlapping with the first radially inwardly facing surface;

wherein, a radius of the first radially inwardly facing surface is larger than a radius of the second radially inwardly facing surface to accommodate a thickness of the abradable lining.

16. A gas turbine engine having a structural subassembly according to claim 1.

17. A gas turbine engine including:

an engine core which comprises a turbine, a compressor having the structural subassembly according to claim 1, and a turbine shaft which is configured as a hollow shaft and connects the turbine to the compressor;

a fan, which is positioned upstream of the engine core, wherein the fan comprises a plurality of fan blades; and a gearbox that receives an input from the turbine shaft and outputs drive for the fan so as to drive the fan at a lower rotational speed than the turbine shaft.

* * * * *